United States Patent [19]

Andra et al.

[11] Patent Number: 4,687,182

[45] Date of Patent: Aug. 18, 1987

[54] HEIGHT ADJUSTABLE POT BEARING

[75] Inventors: Wolfhart Andra, Stuttgart; Karl Bayer, Grosserlach; Erwin Beyer, Dusseldorf; Hans-Peter Andra, Stuttgart, all of Fed. Rep. of Germany

[73] Assignee: SHW Schwabische Huttenwerke GmbH, Aalen-Wasseralfingen, Fed. Rep. of Germany

[21] Appl. No.: 802,775

[22] Filed: Nov. 27, 1985

[30] Foreign Application Priority Data

Nov. 27, 1984 [DE] Fed. Rep. of Germany ..... 3443120

[51] Int. Cl.[4] ..... B66F 3/24

[52] U.S. Cl. ..... 254/93 R; 92/207; 92/247; 92/249

[58] Field of Search ..... 92/181 R, 204, 207, 92/240, 247, 249; 254/93 R, 93 M; 52/744

[56] References Cited

U.S. PATENT DOCUMENTS

| | | | |
|---|---|---|---|
| 1,429,036 | 9/1922 | Iftiger | 92/240 |
| 2,664,163 | 12/1953 | Schnitter | 92/249 |
| 2,727,471 | 12/1955 | Martin | 92/249 |
| 2,753,230 | 7/1956 | Mosites | 92/249 |
| 3,182,568 | 5/1965 | Davis | 92/249 |
| 4,539,895 | 9/1985 | Tanaka et al. | 92/249 |

FOREIGN PATENT DOCUMENTS

| | | | |
|---|---|---|---|
| 1355789 | 6/1974 | United Kingdom | 92/240 |

*Primary Examiner*—Robert C. Watson

*Attorney, Agent, or Firm*—Collard, Roe & Galgano

[57] ABSTRACT

A height adjustable pot bearing is provided having a pot, a steel cover plate and an elastic plate of substantially incompressible elastomeric material disposed in and completely filling the pressure chamber defined between the cover plate and the pot. A circumferential slot is provided in the base of the elastic plate radially inwardly from the outer wall of the plate so that a circumferential lip is formed. The pressurized fluid supplied to the pressure chamber of the pot bearing presses against the base of the elastic plate to lift the elastic plate and the cover plate and forces the circumferential lip radially outwardly against the wall of the pot to seal thereagainst.

9 Claims, 6 Drawing Figures

HEIGHT ADJUSTABLE POT BEARING

The present invention relates generally to a pot bearing and, more particularly, to a pot bearing having an adjustable height level for the transfer, lifting and lowering of heavy structural loads in general and bridges in particular.

Bearings of this type with height level adjustment comprise a pot formed of steel which may be of circular or rectangular construction. Partly inserted into this pot is a lid which is also formed of steel which, in combination with the walls and the base of the pot, forms a fully enclosed pressure chamber. Within this pressure chamber and completely filling it is a plate made of a rubber type elastic and practically incompressible material, preferably an elastomer material. To prevent the elastic material from being forced into the gap between the circumferential surface of the lid and the wall of the pot under high pressure or from egress in an upward direction, a special sealing arrangement is provided which is disposed in a circumferential recess provided on the upper edge of the elastic plate.

This type of bearing construction permits the lid, which supports the structure or part of the bridge, to rotate in any horizontal plane whilst the plate made of elastic material behaves under high pressure like a viscous fluid. Such a bearing can also be utilized upside down so that the pot is on top and the lid at the bottom.

Such bearings can also be used for a subsequent lifting or lowering of the heavy structural load supported thereby. For this purpose they are provided with a device for the injection of a pressurized fluid of low viscosity, which does not attack the elastic material, through an orifice which leads into the totally enclosed pressure chamber. The injection of the pressurized fluid locally displaces the elastic plate and increases the volume of the totally enclosed pressure chamber thereby causing the lid together with the structure which it supports to rise.

Draining of the pressurized fluid reduces the enclosed volume and thereby lowers the lid and the structure it supports. During the lifting or lowering of the load, the vertical circumferential wall of the elastic plate slides along the inner wall of the pot. This leads to problems in that leaks can occur between the wall of the pot and the elastic plate due to the relative movements therebetween resulting from the lifting, lowering and rotational movements of the lid. Such leaks result in an egress of the low viscosity fluid to the outside.

Attempts have been made to counteract this occurrence by the insertion of additional metallic or plastic seals, circumferential in shape, between the inner wall of the pot and the elastic plate. These seals were inserted into recesses in the outer wall of the elastic plate and moved up and down in contact with the inner wall of the pot as the elastic plate moved. Such a system does not achieve a satisfactory and particularly durable seal especially with a low viscosity pressurized fluid and the very high pressures which occur, if frequent lifting and lowering movements take place.

More satisfactory solutions to this problem were sought and it was proposed to provide an elastic enclosure of the pressure chamber so as to avoid moving sealing elements, which for example, can be seen in German patent document DE-AS No. 2527128 and the not yet disclosed German patent application No. P 33 26 068.0-25, which relate to present day technical knowledge.

It is an object of the present invention to provide a height adjustable pot bearing wherein the sealing between the outer wall of the elastic plate and the inner wall of the pot is accomplished without additional sealing elements and in such a way that the elastic plate will itself be able to perform the function of sealing in a reliable manner.

The above object is accomplished according to the present invention by providing a height adjustable pot bearing wherein the elastic plate has a circumferential slot a short distance from the circumference of the inner surface of the pot and concentric with it. This slot is open at the underside of the plate and protrudes into the elastic plate up to three fourths of its thickness. The rim section of the plate, which is separated from the remainder of the elastic plate by the circumferential slot, performs the function of a sealing lip. The injection of pressurized fluid into the circumferential slot and the rising pressure medium, forces this plate rim or sealing lip against the inner wall of the pot and thereby prevents leakage of the pressurized fluid along this contact area. A particularly advantageous construction consists of a design wherein the orifice for the injection of pressurized fluid is positioned immediately below the slot in the elastic plate. This enables the pressurized fluid to enter the slot by the shortest possible path and causes the sealing lip to immediately press against the inner wall of the pot. It is also possible to press the sealing lip, which is separated from the plate by the slot, against the inner wall of the pot not only by means of the pressurized fluid but also by additional means.

Another embodiment of the present invention consists of an arrangement wherein the elastic plate, prior to its insertion into the pot, has at its lower end a larger radius than the radius of the inner wall of the pot as well as the radius of the plate on its top end or surface. The radius of the open slot at the base is increased by a corresponding amount. For insertion, the elastic plate is compressed by means of a clamp to the radius of the inside of the pot and inserted into the pot. After the insertion of the plate, a return spring effect of the pre-compressed sealing lip occurs and creates a desirable and immediately effective primary sealing pressure against the inner wall of the pot so that even prior to the injection of the pressurized fluid the full sealing effect is achieved.

A similar effect can be obtained by means of another embodiment of the present invention. The primary sealing pressure between the sealing lip and the inner wall of the pot can be achieved through the provision, in the circumferential slot in the elastic plate, of an insert of circular or rectangular cross section which bears against one or both walls of the slot and expands the side wall areas of the slot. This increases the outside radius of the elastic plate at its lower end relative to the inside radius of the pot prior to its installation by the amount of the expansion and the elastic plate can be compressed by means of a clamp and inserted into the pot as above described. This embodiment also provides the desired spring-back pressure after the insertion of the pre-compressed elastic plate into the pot and creates a full sealing effect prior to the injection of the pressurized fluid. The above described insert can be rigid in a radial direction or flexible. An insert, which is rigid in the direction of the width of the slot, may consist of a single ring or several segments made of metal or plastic material which is pressed into the slot prior to the insertion of the elastic plate into the pot and extends the slot by the corresponding amount.

In accordance with this last embodiment of the invention, a ring shaped insert which bears against both walls of the slot is shaped in such a manner that the pressure fluid can expand over the full depth of the slot. If, for example, the insert consists of a metallic or plastic ring of triangular cross section, which abuts both walls of the slot and expands them wedge-shaped, the cross section of the insert can be provided with slots which allow the pressurized fluid to rise to the top of the wedge. The horizontal pressure of the fluid can thus act evenly over the entire depth of the slot and force the sealing lip over its full height against the inner wall of the pot.

An insert which is flexible in the radial direction can, for example, consist of ring shaped steel spring strip corrugated in its plan section, which is inserted into the slot and expands it by a certain amount. During the insertion of the elastic plate into the pot with a clamp the expansion caused by the insert, which is flexible in the direction of the slot width is nullified.

If a load is applied to a pot bearing which has been injected with a certain amount of pressurized fluid, a negative lift can occur because the air, which is trapped in the area of the slot by the increasing pressure of the fluid, compresses. Generally such negative lift is of no practical consequence in a construction. If it is to be eliminated for any reason, this may be accomplished by means of the complete or partial filling of the circumferential slot prior to insertion into the pot with a low viscosity substance similar in properties to the fluid, such as grease or the like.

Other objects and features of the present invention will become apparent from the following detailed description considered in connection with the accompanying drawings. It is to be understood, however, that the drawings are designed as an illustration only and not as a definition of the limits of the invention.

In the drawings wherein similar reference characters denote similar elements throughout the several views.

Figure 1:
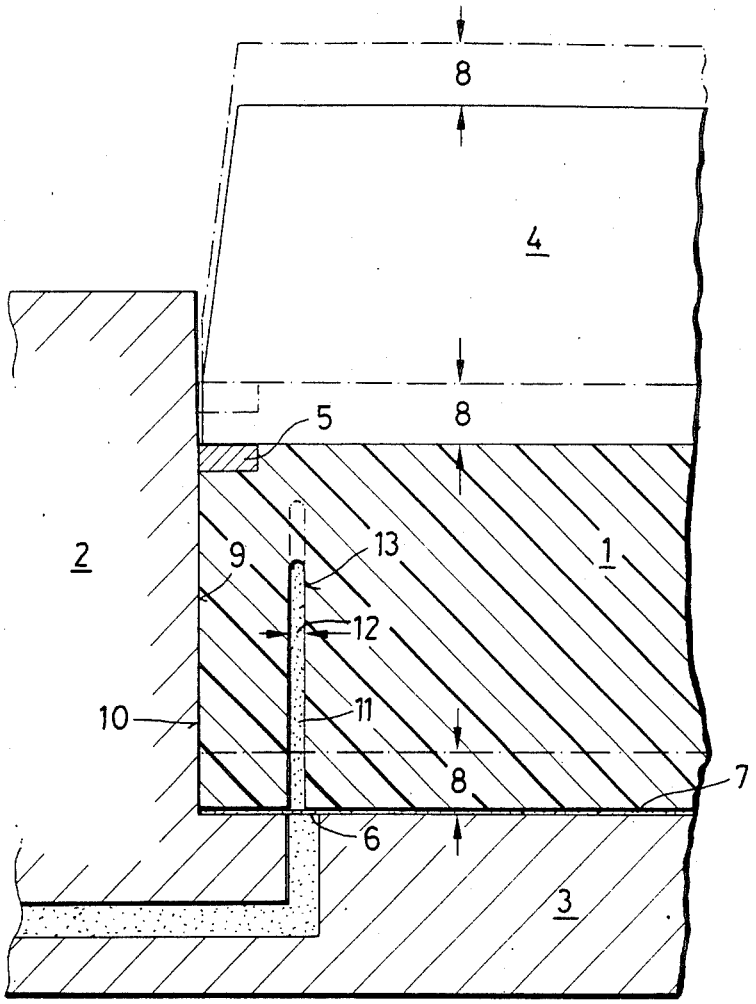
FIG. 1 is a vertical cross-sectional view of the rim area of pot bearing according to the present invention.

Now turning to the drawings, there is shown in FIG. 1 a pot bearing which consists of a pot 2 and 3 with an elastic plate 1 inserted therein and which is covered on top by a lid 4 and fully enclosed with a seal 5.

The pressurized fluid is injected through an orifice 6 into the slot 7 between the surface of the base of pot 3 and the bottom surface of elastic plate 1 which increases the dimension 7 to the dimension 8 and causes elastic plate 1 and lid 4 to lift against the load (not shown) by the same amount. In so doing, the circumferential outer wall surface 9 of plate 1 slides along the inner wall 10 of the pot in a vertical direction.

As clearly seen in FIG. 1, elastic plate 1 has, a small distance from the inner wall of the pot and concentric therewith, a small slot 11 which is open at the bottom and extends up to three quarters of the thickness of plate 1 in an upward direction. The slot width is designated 12 and the side walls 13.

The pressurized fluid which is forced into slot 11 presses the lip shaped rim of plate 1, which is separated by means of slot 11 and radially very flexible, against inner wall 10 of the pot which ensures that the contact area between walls 9 and 10 is properly sealed even if relative movement between elastic plate 1 and inner wall 10 of the pot occurs.

Figure 2:
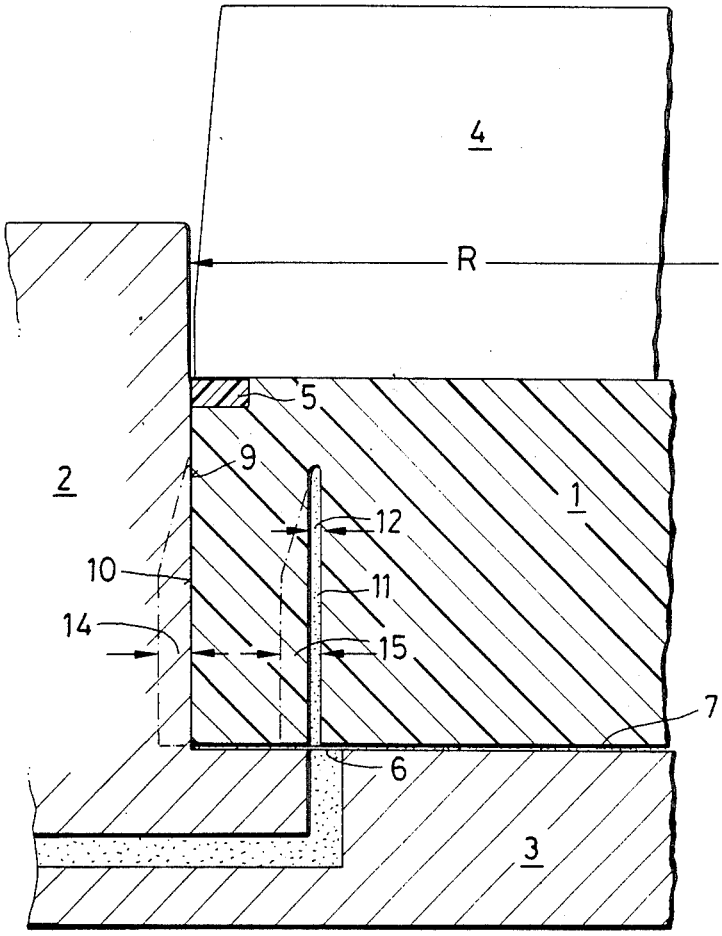
FIG. 2 is a view similar to FIG. 1 of another embodiment of the pot bearing according to the present invention.

In FIG. 2 the extent of the radius of the lower part of elastic plate 1 is shown in phantom to be larger than the radius R of pot 2 by the dimension designated 14. The width of the slot in the lower part is correspondingly increased to the dimension designated 15 which is equivalent to the dimensions 12 plus 14.

In order to install plate 1 into pot 2, 3, the plate is compressed in a radial direction to a diameter 2R whereby the width of the slot is reduced. The resistance to radial compression forces the sealing lip in the lower part against inner wall 10 of the pot. The initial sealing effect is created by a kind of prestressing without hydraulic pressure, i.e. by means of the primary sealing pressure.

Figure 3:
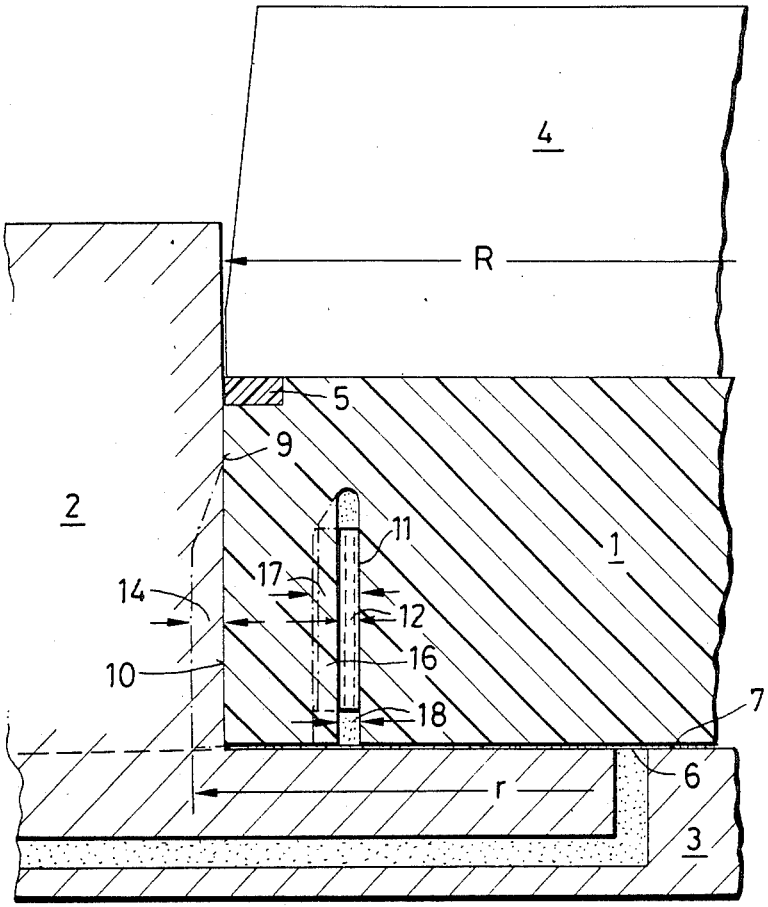
FIG. 3 is a view similar to FIG. 1 of an embodiment of a pot bearing according to the present invention which includes a radially flexible insert in the circumferential slot.

In FIG. 3 the lower part of the elastic plate 1 is shown larger than radius R of the pot by the dimension designated 14 prior to installation. This increase is achieved by the fitting of insert 16, which is elastic in a radial plane, into slot 11 which is thus expanded from the original width 12 to a width designated 17. The insert consists of a ring shaped corrugated spring steel strip which presses locally against both walls of the slot with the peaks and troughs of the corrugation.

During installation of elastic plate 1 into pot 2 with the aid of a clamp, the corrugated ring shaped steel spring 16 is compressed and assumes the shape 18 with flatter corrugations. The sealing lip created by the slot is now pressed against wall 10 of the pot by the pressure exerted by the steel spring insert.

Figure 4:
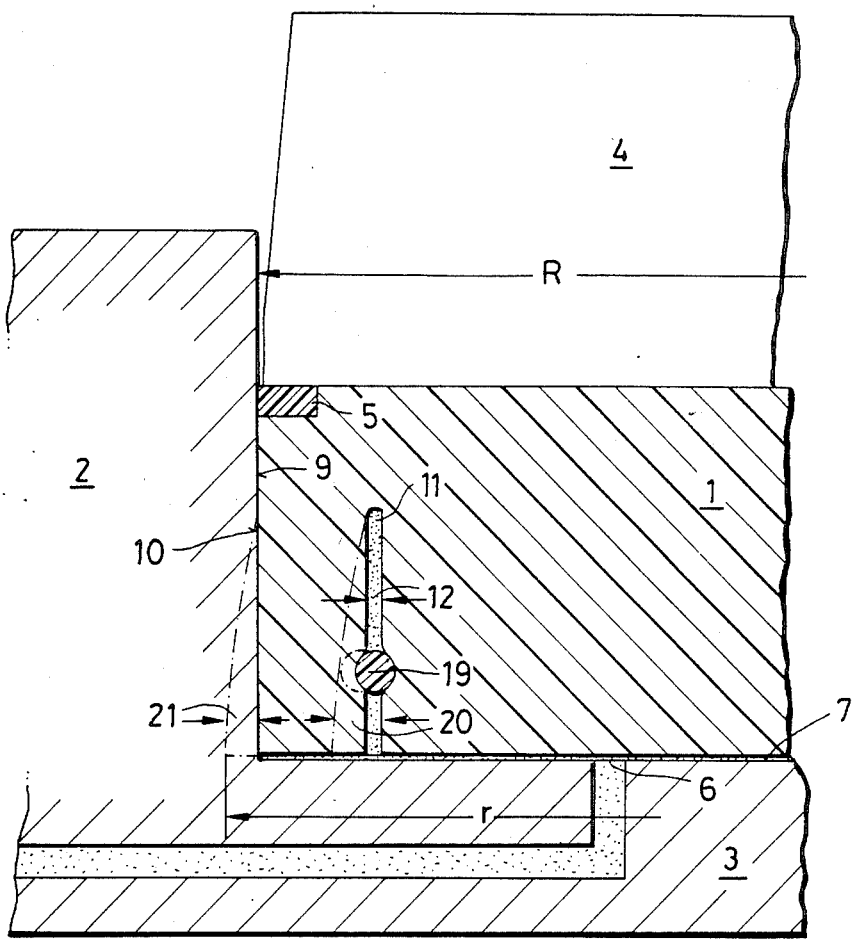
FIG. 4 is a view similar to FIG. 1 which includes an insert of circular cross section, rigid in a radial plane, in the circumferential slot.

In FIG. 4 there is shown a similar embodiment of the present invention of a prestressed sealing lip. In this design, a steel or plastic insert 19 having a circular cross section expands slot 11 in the lower part to the slot width 20 (shown in phantom) prior to installation of elastic plate 1 into pot 2, 3. The radius of elastic plate 1 is increased by the dimension designated 21 over the radius R of the pot. During installation of plate 1 into pot 2 with the aid of a clamp, the increase in radius 21 of elastic plate 1 is nullified. This causes a deformation of the insert in the contact areas. The required radial deformation force corresponds to the pressure of the sealing lip against inner wall 10 of the pot.

Figure 5:
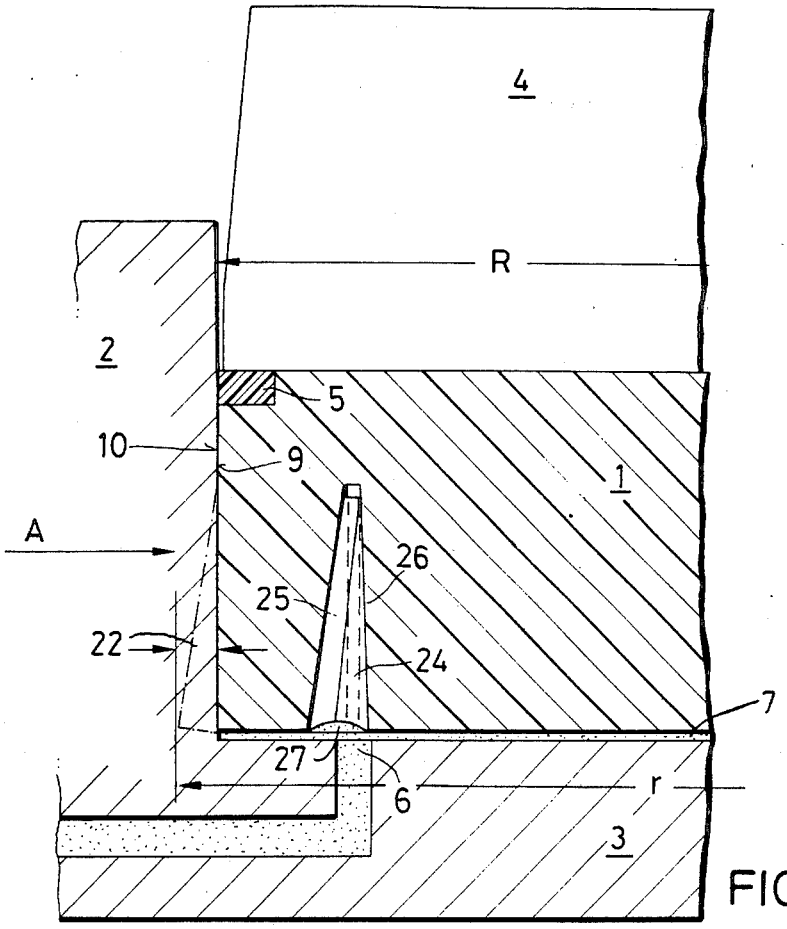
FIG. 5 is a view similar to FIG. 1 which includes a wedge shaped, radially slotted insert in the circumferential slot.

In FIG. 5 there is shown another embodiment of the present invention of a pre-compressed sealing lip. Prior to installation into pot 2, 3, slot 23 of elastic plate 1 is expanded in the lower part thereof by a ring shaped spreader 24 of triangular or trapezoidal cross section. Ring shaped spreader 24 is provided with slots 25 in a vertical direction. This creates hollows which the subsequently injected and rising pressurized fluid fills.

The spreader extends the elastic plate in the lower part and increases the radius r of elastic plate 1 by the amount 22. During installation this radius is reduced to the inner radius of the pot with a clamp as already described.

Figure 6:
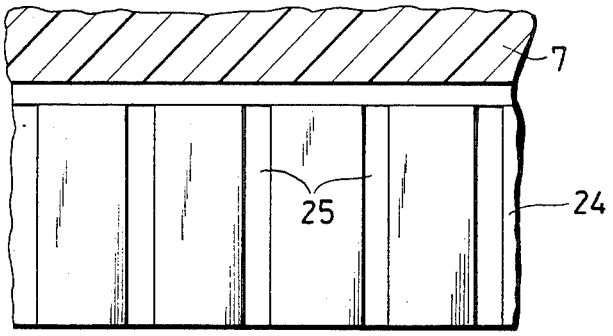
FIG. 6 is a view of the radially slotted wedge shaped insert of FIG. 5 as viewed in the direction of arrow "A".

In FIG. 6 a view of spreader 24 with vertical slots 25 as viewed in the direction of arrow A of FIG. 5 is shown.

Not illustrated or described in detail is the possibility, prior to the installation of the elastic plate into the housing, to partially or completely fill the circumferential slot with a material similar in properties to the pressurized fluid so as to expel any air in the slot.

While several embodiments of the present invention have been shown and described, it will be obvious that many changes and modifications may be made thereunto without departing from the spirit and scope of the invention.

What is claimed is:

1. In a height adjustable pot bearing for the transfer, lifting and lowering of heavy structural loads, particularly bridge structures, which includes a steel pot, a steel cover plate and a seal and which forms a completely enclosed pressure chamber which is completely filled by an elastic plate formed of a rubber type substantially incompressible elastomer material, wherein for lifting a pressurized fluid is injected between the base of the pot and the elastic plate through an orifice in the pot which locally displaces the elastic plate and raises the cover plate and for lowering an amount of pressurized fluid is released, the improvement comprising a small slot formed in said elastic plate a short distance from the circumference of the inner wall of the pot and concentric therewith, said slot being open at the base of the elastic plate and extending to approximately three quarters the thickness of the elastic plate, and a ring shaped insert of wedge-shaped cross section in said slot which causes the outer radius of the elastic plate to spread and become larger than the inner radius of the pot and the elastic plate is capable of being compressed to the inner radius of the pot.

2. The pot bearing according to claim 1, wherein said ring shaped insert is trapezoidal in cross section.

3. The pot bearing according to claim 1, wherein the ring shaped insert is provided with radially arranged vertical slots to a depth of between one to two thirds of the overall thickness of the insert.

4. The pot bearing according to claim 2, wherein the ring shaped insert is provided with radially arranged vertical slots to a depth of between one to two thirds of the overall thickness of the insert.

5. The pot bearing according to claim 1, wherein the side of the insert facing the base of the pot is provided with a circumferential flat groove and the orifice delivering pressurized fluid is positioned directly below said groove.

6. The pot bearing according to claim 2, wherein the side of the insert facing the base of the pot is provided with a circumferential flat groove and the orifice delivering pressurized fluid is positioned directly below said groove.

7. In a height adjustable pot bearing for the transfer, lifting and lowering of heavy structural loads, particularly bridge structures, which includes a steel pot, a steel cover plate and a seal and which forms a completely enclosed pressure chamber which is completely filled by an elastic plate formed of a rubber type substantially incompressible elastomer material, wherein for lifting a pressurized fluid is injected between the base of the pot and the elastic plate through an orifice in the pot which locally displaces the elastic plate and raises the cover plate and for lowering an amount of pressurized fluid is released, the improvement comprising a small slot formed in said elastic plate a short distance from the circumference of the inner wall of the pot and concentric therewith, said slot being open at the base of the elastic plate and extending to approximately three quarters the thickness of the elastic plate, and a ring shaped insert consisting of several segments bearing against at least one wall of the slot to expand the lower part of the elastic plate so that it is larger than the inner radius of the pot, the lower part of the elastic plate being capable of being compressed so as to be inserted into the pot.

8. In a height adjustable pot bearing for the transfer, lifting and lowering of heavy structural loads, particularly bridge structures, which includes a steel pot, a steel cover plate and a seal and which forms a completely enclosed pressure chamber which is completely filled by an elastic plate formed of a rubber type substantially incompressible elastomer material, wherein for lifting a pressurized fluid is injected between the base of the pot and the elastic plate through an orifice in the pot which locally displaces the elastic plate and raises the cover plate and for lowering an amount of pressurized fluid is released, the improvement comprising a small slot formed in said elastic plate a short distance from the circumference of the inner wall of the pot and concentric therewith, said slot being open at the base of the elastic plate and extending to approximately three quarters the thickness of the elastic plate, and an insert comprising a ring shaped spreading device of circular cross section provided at a certain distance from the base of the elastic plate in said slot so that the outer radius of the lower part of the plate is increased by the amount of spread and is larger than the inside radius of the pot, and the elastic plate is capable of being compressed to the inside radius of the pot.

9. In a height adjustable pot bearing for the transfer, lifting and lowering of heavy structural loads, particularly bridge structures, which includes a steel pot, a steel cover plate and a seal and which forms a completely enclosed pressure chamber which is completely filled by an elastic plate formed of a rubber type substantially incompressible elastomer material, wherein for lifting a pressurized fluid is injected between the base of the pot and the elastic plate through an orifice in the pot which locally displaces the elastic plate and raises the cover plate and for lowering an amount of pressurized fluid is released, the improvement comprising a small slot formed in said elastic plate a short distance from the circumference of the inner wall of the pot and concentric therewith, the orifice in said pot being arranged immediately below said circumferential slot, said slot being open at the base of the elastic plate and extending to approximately three quarters the thickness of the elastic plate, and an insert which bears against at least one wall of the slot to expand the lower part of the elastic plate so that it is larger than the inner radius of the pot, the lower part of the elastic plate being capable of being compressed so as to be inserted into the pot.

* * * * *